219-121
7/4/78 XR 4,097,988

United States Patent [19]
Hauschild

[11] 4,097,988
[45] Jul. 4, 1978

[54] METHOD OF MANUFACTURING THICK-FILM RESISTORS TO PRECISE ELECTRICAL VALUES

[75] Inventor: Frank-Dieter Hauschild, Nordstemmen, Germany

[73] Assignee: Blaupunkt-Werke GmbH, Hildesheim, Germany

[21] Appl. No.: 808,643

[22] Filed: Jun. 21, 1977

[30] Foreign Application Priority Data

Jul. 6, 1976 [DE] Fed. Rep. of Germany ..... 2630237

[51] Int. Cl.[2] ..... H01C 17/06
[52] U.S. Cl. ..... 29/620; 219/121 LM; 219/121 EM; 338/195; 338/308
[58] Field of Search ..... 29/610 R, 620; 338/195, 338/308; 219/121 LM, 121 EM

[56] References Cited

U.S. PATENT DOCUMENTS

| | | | |
|---|---|---|---|
| 3,573,703 | 4/1971 | Burks | 29/620 X |
| 3,594,679 | 7/1971 | Leay | 29/620 X |
| 3,787,965 | 1/1974 | Cocca et al. | 29/620 |
| 3,889,223 | 6/1975 | Sella et al. | 29/620 X |
| 3,947,801 | 3/1976 | Bube | 29/620 |
| 4,041,440 | 8/1977 | Davis et al. | 29/620 X |

FOREIGN PATENT DOCUMENTS

| | | | |
|---|---|---|---|
| 2,054,721 | 5/1972 | Fed. Rep. of Germany | 338/195 |

*Primary Examiner*—Victor A. DiPalma
*Attorney, Agent, or Firm*—Flynn & Frishauf

[57] ABSTRACT

The resistance material of a thick-film resistor is applied to a substrate in a layer having a configuration that tapers in a direction transverse to the direction of flow of current and the conductive leads are provided in contact with the tapering edges of the layer. A small incision on the shorter side of the layer between the tapering edges to which the leads are applied will have a relatively large effect on the resistance value without great effect on the amount of the area that determines the power rating of the resistor, so that trimmming by such an incision can be done quickly and the resistance change with progressive incision is more uniform than in the case of a resistor layer of rectangular configuration.

7 Claims, 3 Drawing Figures

METHOD OF MANUFACTURING THICK-FILM RESISTORS TO PRECISE ELECTRICAL VALUES

Figure 1:
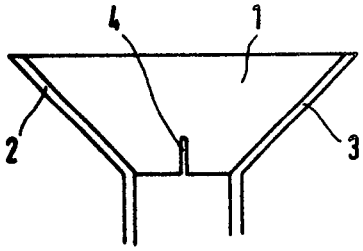

The present invention relates to a method of manufacturing improved thick-film resistors applied onto plane substrates.

In the course of the progressing miniaturization of electronic assemblies, the individual component parts of an electronic circuit, integrated circuits, semiconductor chips having special functions such as luminescent diodes, and electrical resistors and other passive devices have together been arranged on substrates, and are electrically connected so that they form a functional unit. As a result, the reliability in service of complicated electronic appliances is increased and maintenance and repair thereof are simplified.

A practical method of producing the resistors is to distribute a paste on the substrates mentioned above. In this case, the amount of resistance will depend upon the thickness of the paste layer, the composition of the paste, and the extent of the area covered with the paste. The applied resistance paste can be dried and hardened by subsequent heat treatment.

In electronic circuits, it is frequently necessary to trim the electrical values of individual components to each other. In conventional circuits, this is often performed by trimming potentiometers. In microminiaturized circuits, however, this is not possible and special methods have been developed for these circuits.

In the British patent specification 1,066,125, for example, a method is described for producing electrical resistors secured to a substrate for microminiaturized circuits. This patent specification is concerned with tabular rectangular resistors each provided with a strip-shaped recess at one of its longitudinal sides.

Moreover, it is a known practice to subsequently trim resistors of microminiaturized circuits, for example, by means of a laser as described in the above-mentioned British patent specification.

When utilized in combination with the resistors according to the British patent specification 1,066,125, the described trimming method has serious disadvantages.

When rectangular resistors are trimmed by means of a laser by an incision made perpendicular to the original path of current, the effective resistive area determining the carrying capacity of the respective resistor will be considerably reduced, though this is not intended. Furthermore, a very long incision has to be made by means of the laser beam for trimming purposes to effect the required resistance variation. Thereby, longer periods of time delaying the further steps of manufacture are necessitated for the trimming process. Consequently, a method as there described cannot be integrated in a more complex course of manufacture without some difficulty.

Therefore, an object of the present invention is to develop a method of manufacturing improved thick-film resistors applied onto plane substrates. These thick-film resistors are required to be easy to trim, and, above all, an extended range of resistance variation should be provided by comparatively short trimming incisions. Furthermore, the resistive area remaining after the trimming operation effective for determining the carrying capacity of the thick-film resistor should be as large as possible and it should be possible to integrate both the mentioned method of manufacturing thick-film resistors and the process of trimming the latter into the further course of manufacture without difficulty.

SUMMARY OF THE INVENTION

Briefly, the resistor material of the thick-film resistor is applied onto a substrate in the configuration of a finite surface bounded by at least one straight border and tapering with increasing distance from this straight border, and two current leads are provided on this surface along the tapering borders, after which the resistance material is partly removed in a direction substantially perpendicular to the straight border from that portion located at the greatest distance from the aforesaid straight border.

It has turned out to be highly advantageous to apply the thick-film resistors onto the substrates so as to form a trapezoidal pattern. The electrical connectors are then arranged at the oblique sides of the trapezoid and the trimming incision is made starting from a location on the shorter of the two parallel sides.

It is likewise possible to apply the thick-film resistor onto the substrate so as to form a semicircular disk. In this case, the current leads can be arranged along the semicircular border. The incision for trimming purposes should then be made starting from the middle of the semicircular circumferential line.

Owing to the fact that the thick-film resistor is designed so as to have the configuration of a tapering surface and that the resistance material is partly removed in the tapered portion, starting from the circumferential line, the change of resistance achieved by only a minor removal, e.g. an incision, is considerably greater than those achievable by proceeding likewise with a rectangular resistor.

This effect is readily comprehensible when the thick-film resistor with the configuration of a tapering surface is looked upon as a parallel connection of resistors of increasing values, the resistors of low values corresponding to the tapered portion and resistors of high values corresponding to the long portion of the thick-film resistor, An incision in the tapered portion corresponds to the removal of resistors of low values from the parallel connection. Consequently, only the resistors of high value are left determining the total resistance. As the reciprocal value of the total resistance is equal to the sum of the reciprocal values of the individual resistors when resistors are connected in parallel, the total resistance is considerably increased by removal of a low parallel resistance.

A rectangular thick-film resistor, however, when it is approached to in the same way, i.e. considered as a collection of equal-width strips connected in parallel, has to be looked upon as a parallel connection of equally high-valued resistors. If it is assumed that the rectangular thick-film resistor has — before the trimming operation is started — the same initial resistance as the reference resistor having the configuration of a tapering surface, then the total resistance will vary but slightly when a trimming incision of equal length is made into a rectangular thick-film resistor, since a resistor of comparatively high value is removed from the parallel connection. Hence follows that a longer trimming incision is required for obtaining the same change of resistance as in the preceding case of a tapered surface resistor. Furthermore, the resistance change per increment of incision length is more uniform in the case of the present invention.

As a result, the trimming of resistors manufactured according to the present invention is simplified by the use of shorter incisions requiring less time. The effective area of the thick-film resistors which determine the carrying capacity is but insignificantly reduced.

Figure 2:
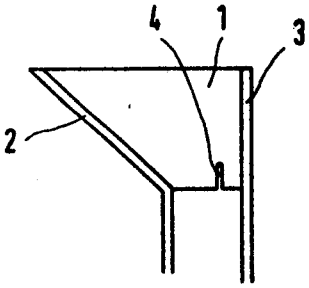
Figure 3:
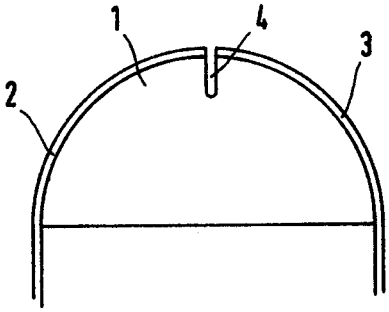

The invention is further described by way of illustrative example with reference to the annexed drawing, in which:

FIGS. 1 and 2 are diagrammatic plan views illustrating examples of trapezoidal thick-film resistors according to the invention, and FIG. 3 similarly illustrates a semicircular example of a thick-film resistor according to the invention.

The particular configuration of a thick-film resistor according to the invention will generally be chosen in dependence upon the layout of the electronic circuit on the whole. Very little space is required for integrating resistors of trapezoidal configuration into a complete circuit arrangement.

The trimming incision can be made in different ways, for example, by means of a light beam of high power density such as a laser beam. Thick-film resistors comprised in controlled or regulated devices can very exactly be trimmed that way to preset desired values. It is likewise possible to make the incision by means of an electronic beam in vacuum.

These resistors can easily be applied onto the substrate of a microminiaturized circuit by known methods of thick-film resistor manufacture, only little space being required. These thick-film resistors of the present invention can be trimmed to exactly predetermined desired values by making short trimming incisions. By means of these short trimming incisions, comparatively great resistance variations can be produced while the effective resistance surface determining the carrying capacity of the thick-film resistors is but insignificantly reduced. As the method according to the present invention requires only very short time for one production cycle, it is capable of being readily fitted into a more complex process of manufacture, the further course of manufacture being not adversely affected by the interposition of the trimming step.

We claim:

1. A method of manufacturing improved thick-film resistors on plane substrates, including the steps of:

applying the resistance material of the thick-film resistor (1) onto a substrate in a layer so as to cause said layer to have the configuration of a finite surface bounded by at least one straight border and tapering with increasing distance from this straight border;

providing two current leads (2,3) in contact with respective edges of said layer along the tapering borders of said surface, and partly removing the resistance material in a direction substantially perpendicular to said straight border from the portion of said layer located at the greatest distance from said straight border.

2. A method according to claim 1, in which the thick-film resistor (1) is applied onto a substrate as a layer having the shape of a trapezoid, in which, further, the two current leads (2,3) are provided along the respective non-parallel sides of the trapezoid, and in which the partial removal of the resistance material is performed by an incision (4) in said layer starting from the shorter of the two parallel sides of the trapezoid.

3. A method according to claim 1, in which the thick-film resistor (1) is applied onto the substrate as a layer in the shape of a semicircle, in which, further, the two current leads (2,3) are provided aong the semicircular border of the layer, and in which the partial removal of the resistance material is performed by an incision (4) in said layer starting from the middle of the semicircular circumferential line.

4. A method according to claim 1, in which the step of removing resistance material from the thick-film resistor layer (1) is performed by cutting out a narrow strip of the layer (4).

5. A method according to claim 4, in which the removal of resistance material from the thick-film resistor layer (1) is performed by means of a light beam of high power density.

6. A method according to claim 5, in which said light beam is produced by means of a laser.

7. A method according to claim 4, in which the removal of resistance material from the thick-film resistor layer (1) is performed by means of an electron beam in a vacuum.

* * * * *